US008776484B2

(12) United States Patent
Kondo et al.

(10) Patent No.: US 8,776,484 B2
(45) Date of Patent: Jul. 15, 2014

(54) FORM-FILL-SEAL MACHINE

(75) Inventors: Masashi Kondo, Shiga (JP); Makoto Ichikawa, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 341 days.

(21) Appl. No.: 12/959,565

(22) Filed: Dec. 3, 2010

(65) Prior Publication Data

US 2011/0131935 A1 Jun. 9, 2011

(30) Foreign Application Priority Data

Dec. 7, 2009 (JP) ..... 2009-277504

(51) Int. Cl.
*B65B 9/06* (2012.01)
*B31B 19/52* (2006.01)

(52) U.S. Cl.
USPC ..... 53/551; 53/574; 493/243; 493/437

(58) Field of Classification Search
USPC ..... 53/551, 574; 493/243, 248, 250, 439
See application file for complete search history.

(56) References Cited

U.S. PATENT DOCUMENTS

| | | | | | |
|---|---|---|---|---|---|
| 2,631,332 | A | * | 3/1953 | Reber | 425/326.1 |
| 3,353,327 | A | * | 11/1967 | Cutler et al. | 53/451 |
| 3,566,756 | A | * | 3/1971 | Schmid et al. | 493/439 |
| 3,785,112 | A | * | 1/1974 | Leasure et al. | 53/451 |
| 4,949,846 | A | * | 8/1990 | Lakey | 206/484 |
| 5,246,416 | A | * | 9/1993 | Demura et al. | 493/439 |
| 5,311,726 | A | * | 5/1994 | Rauscher et al. | 53/511 |
| 5,548,946 | A | * | 8/1996 | Holub | 53/550 |
| 5,768,863 | A | * | 6/1998 | McGregor et al. | 53/570 |
| 5,957,823 | A | * | 9/1999 | Fan | 493/248 |
| 6,134,864 | A | * | 10/2000 | McGregor et al. | 53/459 |
| 6,145,282 | A | * | 11/2000 | Tsuruta | 53/551 |
| 6,212,861 | B1 | * | 4/2001 | Tsuruta | 53/551 |
| 6,408,599 | B1 | * | 6/2002 | Nakagawa et al. | 53/451 |

(Continued)

FOREIGN PATENT DOCUMENTS

| | | | |
|---|---|---|---|
| JP | S41-19428 | U | 9/1966 |
| JP | 48-014716 | B | 5/1973 |
| JP | 07-156908 | A | 6/1995 |
| JP | 2007-145366 | A | 6/2007 |

OTHER PUBLICATIONS

Extended European Search Report dated Apr. 28, 2011 for the corresponding European Application No. 10193188.9.

(Continued)

*Primary Examiner* — Hemant M Desai
*Assistant Examiner* — Gloria R Weeks
(74) *Attorney, Agent, or Firm* — Global IP Counselors, LLP

(57) ABSTRACT

A form-fill-seal machine is adapted to manufacture a bag having a gusset section, and includes a conveying part, a plurality of splitters and an inward-folding member. The conveying part is configured and arranged to convey a tubular packaging material. The splitters extend along a conveyance direction of the tubular packaging material to contact with the tubular packaging material from an interior side. The inward-folding member has a pressing part including a plurality of contacting portions that are three-dimensionally arranged to generally correspond to a shape of the gusset section. The inward-folding member is configured and arranged to press the contacting portions of the pressing part from an external side of the tubular packaging material against an outer surface of a gusset formation area of the tubular packaging material located between the splitters to form the gusset section.

16 Claims, 7 Drawing Sheets

(56) References Cited

U.S. PATENT DOCUMENTS

| | | | | |
|---|---|---|---|---|
| 6,519,917 | B2 * | 2/2003 | Forman | 53/412 |
| 6,526,733 | B1 * | 3/2003 | Schellenberg et al. | 53/551 |
| 6,655,110 | B2 * | 12/2003 | Taylor | 53/373.9 |
| 6,679,034 | B2 * | 1/2004 | Kohl et al. | 53/551 |
| 7,299,608 | B2 * | 11/2007 | Kohl et al. | 53/551 |
| 2001/0005979 | A1 * | 7/2001 | Kuss et al. | 53/551 |
| 2002/0023410 | A1 * | 2/2002 | Seaward et al. | 53/434 |
| 2002/0046548 | A1 | 4/2002 | Forman | |
| 2004/0083685 | A1 * | 5/2004 | Knoerzer et al. | 53/412 |
| 2005/0115211 | A1 * | 6/2005 | Knoerzer et al. | 53/551 |
| 2005/0198929 | A1 * | 9/2005 | Gehring et al. | 53/451 |
| 2005/0210840 | A1 * | 9/2005 | Kohl et al. | 53/551 |
| 2006/0064947 | A1 | 3/2006 | Bartel et al. | |
| 2008/0034713 | A1 * | 2/2008 | Kohl et al. | 53/551 |
| 2010/0037567 | A1 * | 2/2010 | Tsuruta et al. | 53/551 |

OTHER PUBLICATIONS

Japanese Office Action of the corresponding Japanese Application No. 2009-277504, dated Oct. 10, 2013.

* cited by examiner

FORM-FILL-SEAL MACHINE

CROSS-REFERENCE TO RELATED APPLICATIONS

This application claims priority to Japanese Patent Application No. 2009-277504 filed on Dec. 7, 2009. The entire disclosure of Japanese Patent Application No. 2009-277504 is hereby incorporated herein by reference.

BACKGROUND

1. Technical Field

The present invention relates to a form-fill-seal machine for continuously manufacturing bags, and in particular to a form-fill-seal machine provided with a gusset-forming mechanism for forming a gusset (i.e., an inwardly folded portion) on both side parts of the bag.

2. Related Art

Form-fill-seal machines are in widespread use as bag manufacturing and packaging devices for simultaneously manufacturing bags and filling them with packaged items such as snack foods. For example, a vertical-type form-fill-seal machine known as a pillow packaging machine uses a former and a tube to form a packaging material, which is a sheet of film, into a cylindrical shape; uses a vertical seal mechanism to thermally fuse a vertical edge of the overlapped packaging material; and forms a tubular packaging material. This form-fill-seal machine also fills an interior of the tubular packaging material with a packaged item through a tube, and uses a lateral seal mechanism under the tube to thermally fuse across an upper end part of the bag and a lower end part of a subsequent bag.

Form-fill-seal machines of such description also include those that perform bag manufacture while forming a gusset (i.e., an inwardly-folded portion) at positions corresponding to both side parts of the bag. For example, a vertical-type form-fill-seal machine disclosed in patent literature 1 (JP-A 7-156908) drives so as to insert/remove a pair of left and right gusset plates against an intermittently conveyed packaging material, and is thereby capable of forming a gusset on a side part of a bag.

SUMMARY

However, with conventional form-fill-seal machines as described above, in an instance in which the gusset is formed while the packaging material is being conveyed, there is a high possibility of the gusset plate not being completely suited to the shape of a gusset formation area that changes with conveyance of the packaging material, the gusset formation area becoming slack, and a gusset having an unappealing appearance being formed.

An object of the present invention is to provide a form-fill-seal machine capable of forming a gusset having an appealing appearance, even when forming a gusset while conveying a packaging material.

A form-fill-seal machine according to a first aspect of the invention is adapted to manufacture a bag having a gusset section, and includes a conveying part, a plurality of splitters and an inward-folding member. The conveying part is configured and arranged to convey a tubular packaging material. The splitters extend along a conveyance direction of the tubular packaging material to contact with the tubular packaging material from an interior side. The inward-folding member has a pressing part including a plurality of contacting portions that are three-dimensionally arranged to generally correspond to a shape of the gusset section. The inward-folding member is configured and arranged to press the pressing part from an external side of the tubular packaging material against an outer surface of a gusset formation area of the tubular packaging material located between the splitters to form the gusset section.

According to this form-fill-seal machine, the pressing part includes a plurality of contacting portions that are three-dimensionally arranged to generally correspond to a shape of the gusset section, and tension therefore acts on the entirety of the gusset formation area (i.e., a portion of the tubular packaging material reserved for gusset formation). As a result, slackness in the gusset formation area is substantially eliminated, and a gusset having an appealing appearance is formed.

A form-fill-seal machine according to a second aspect of the present invention is the form-fill-seal machine according to the first aspect of the present invention, wherein the splitters are arranged with respect to the conveying part to form four corners of the tubular packaging material. Although the four corners of the tubular packaging material are generally likely to become distorted in shape during gusset formation, in the form-fill-seal machine, the splitters minimize shape distortion of the four corners.

A form-fill-seal machine according to a third aspect is the form-fill-seal machine according to the first aspect of the present invention, wherein the pressing part forms three linear contacting surfaces defining the contacting portions. In the form-fill-seal machine, the gusset formation area clings to the three linear contacting surfaces and forms a three-dimensional shape, and tension therefore acts on the entirety of the gusset formation area. As a result, slackness is substantially eliminated, and a gusset having an appealing appearance is formed.

A form-fill-seal machine according to a fourth aspect of the present invention is the form-fill-seal machine according to the first aspect of the present invention, further including a first actuator and a second actuator. The first actuator is configured and arranged to move the inward-folding member in a first motion, in which the pressing part presses against and separates from the gusset formation area of the tubular packaging material. The second actuator is configured and arranged to move the inward-folding member in a second motion, in which the pressing part presses against and separates from the gusset formation area, independently of the first motion while the first actuator moves the inward-folding member in the first motion.

Generally, in a form-fill-seal machine, the fold-in depth during gusset formation increases with increasing bag size; however, a space in which the inward-folding member can move is limited, and there is accordingly a possibility of the fold-in depth becoming insufficient, the gusset formation area becoming slack, and a gusset having an unappealing appearance being formed. However, according to this form-fill-seal machine, even in an instance in which the gusset formation area becomes slack after the inward-folding member performing the first motion separates from the gusset formation area, the second motion causes the inward-folding member to inwardly fold the gusset formation area; therefore, the fold-in depth increases, slackness is substantially eliminated, and the gusset having an appealing appearance is formed.

A form-fill-seal machine according to the fifth aspect of the present invention is the form-fill-seal machine according to the fourth aspect of the present invention, wherein the second actuator is configured and arranged to move the inward-folding member in the second motion that is a reciprocating motion in which the pressing part presses against the tubular packaging material diagonally downwards relative to a horizontal direction. Generally, in a form-fill-seal machine, not only the depth, but also the length of the inward fold during gusset formation increases with increasing bag size; however, a space in which the inward-folding member can move is limited, and there is accordingly a possibility of the length of the fold-in becoming insufficient, and a gusset having an unappealing appearance being formed. However, according to this form-fill-seal machine, after the inward-folding member performing the first motion separates from the gusset formation area, the second motion causes the inward-folding member to press diagonally downwards relative to the horizontal, and again inwardly fold the gusset formation area. Therefore, the amount of fold-in along a direction of conveyance of the tubular packaging material is increased, slackness is substantially eliminated, and the gusset having an appealing appearance is formed.

A form-fill-seal machine according to a sixth aspect of the present invention is a form-fill-seal machine according to the fourth aspect of the present invention, wherein the first actuator is configured and arranged to move the inward-folding member in the first motion that is a rotating motion, and the second actuator is configured and arranged to move the inward-folding member in the second motion after the pressing part of the inward-folding member moving in the first motion separates from the gusset formation area of the tubular packaging material.

According to this form-fill-seal machine, the first motion of the inward-folding member is a rotating motion; therefore, a space in which movement can take place is constant and does not increase, and the fold-in depth and length cannot be increased using the first motion alone. However, the second motion causes the inward-folding member to press diagonally downwards relative to the horizontal, and both the depth and the length of the fold-in thereby increase. Also, the gusset formation area can be pressed by the inward-folding member when the inward-folding member separates from the gusset formation area and the gusset formation area is likely to become slack. As a result, a gusset having an appealing appearance is formed.

A form-fill-seal machine according to a seventh aspect of the present invention is the form-fill-seal machine according to the first aspect of the present invention, wherein the pressing part includes a first plate and a second plate that face each other, and the first plate and the second plate are arranged such that, when an external force acts so as to move the first plate and the second plate closer to each other, a gap between the first plate and the second plate becomes narrower in response to the external force.

According to this form-fill-seal machine, even when the pressing part presses from an outside of the tubular packaging material against an outer surface of the gusset formation area, and an external force acts so as to move the first plate and the second place closer to each other, the gap between the first place and the second plate becomes narrower in response to the external force, and the gusset formation area is therefore not subjected to tension in excess of what is necessary.

A form-fill-seal machine according to an eighth aspect of the present invention is the form-fill-seal machine according to the seventh aspect of the present invention, wherein the first plate and the second plate are configured and arranged to press against the gusset formation area of the tubular packaging material to inwardly fold the tubular packaging material while a width of the gusset formation area becomes narrower as the first plate and the second plate move closer to each other according to a fold-in depth.

According to this form-fill-seal machine, even when the pressing part presses from an outside of the tubular packaging material against an outer surface of the gusset formation area, and the width of the gusset formation area becomes narrower, the first plate and the second place move closer to each other, and the gusset formation area is therefore not subjected to tension in excess of what is necessary.

A form-fill-seal machine according to a ninth aspect of the present invention is a form-fill-seal machine according to the eighth aspect of the present invention, wherein a gap between upper ends of the first plate and the second plate is larger than a gap between lower ends of the first plate and the second plate so that the first and second plates form a V-shape, and the first plate and the second plate are configured and arranged to press against the gusset formation area of the tubular packaging material to inwardly fold the tubular packaging material as the gap between the upper ends of the first plate and the second plate becomes narrower according to the fold-in depth.

According to this form-fill-seal machine, even when the pressing part presses from an outside of the tubular packaging material against an outer surface of the gusset formation area, and the width of the gusset formation area becomes narrower, the gap between the respective distal ends of the first plate and the second place becomes narrower, and the gusset formation area is therefore not subjected to tension in excess of what is necessary.

A form-fill-seal machine according to the tenth aspect of the present invention is the form-fill-seal machine according to any one of the seventh through the ninth aspects of the present invention, wherein the first plate and the second plate are resilient plate members.

According to this form-fill-seal machine, the first plate and the second plate undergo elastic deformation, and tension thereby acts on the entirety of the gusset formation area; therefore, slackness in the gusset formation area is substantially eliminated, and a gusset having an appealing appearance is formed.

According to the above aspects of the present invention, the pressing part includes a plurality of contacting portions that are three-dimensionally arranged to generally correspond to a shape of the gusset, and tension therefore acts on the entirety of the gusset formation area. As a result, slackness in the gusset formation area is substantially eliminated, and a gusset having an appealing appearance is formed.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention will now be described with reference to drawings below. The following embodiment is a specific example of the present invention, and is not intended to limit the technological scope of the present invention.

Overall Configuration of Combination Measuring System 10

Figure 1:
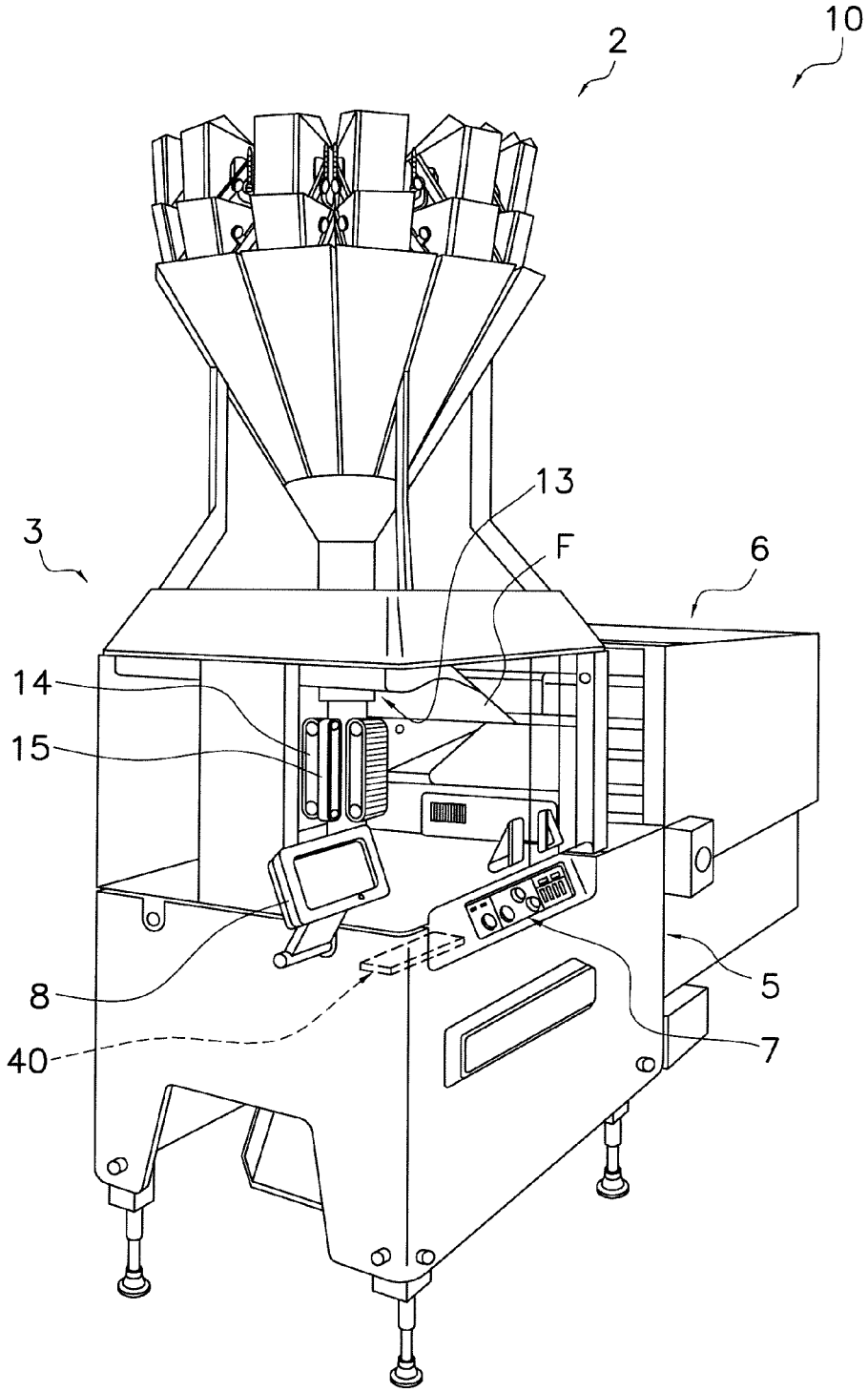
FIG. 1 is a perspective view of a combination measuring system provided with a form-fill-seal machine according to an embodiment of the present invention.

FIG. 1 is a perspective view of a combination measuring system provided with a form-fill-seal machine according to an embodiment of the present invention. In FIG. 1, the combination measuring system 10 mainly comprises a combination measuring machine 2 and a form-fill-seal machine 3.

The combination measuring machine 2, provided at a top part of the form-fill-seal machine 3, weighs out an item to predetermined weight values using a measuring hopper, then combines the measurements values so that a predetermined total weight is reached, and sequentially discharges measured items as a commercial product C. The form-fill-seal machine 3 packages the commercial item C discharged from the combination measuring machine 2 using a continuously conveyed film F.

Configuration of Form-Fill-Seal Machine 3

The form-fill-seal machine 3 includes a bag manufacturing and packaging unit 5 and a film feed unit 6. The film feed unit 6 is a unit for feeding a sheet of film F into a forming mechanism 13 of the bag manufacturing and packaging unit 5, and is provided adjacent to the bag manufacturing and packaging unit 5.

Figure 2:
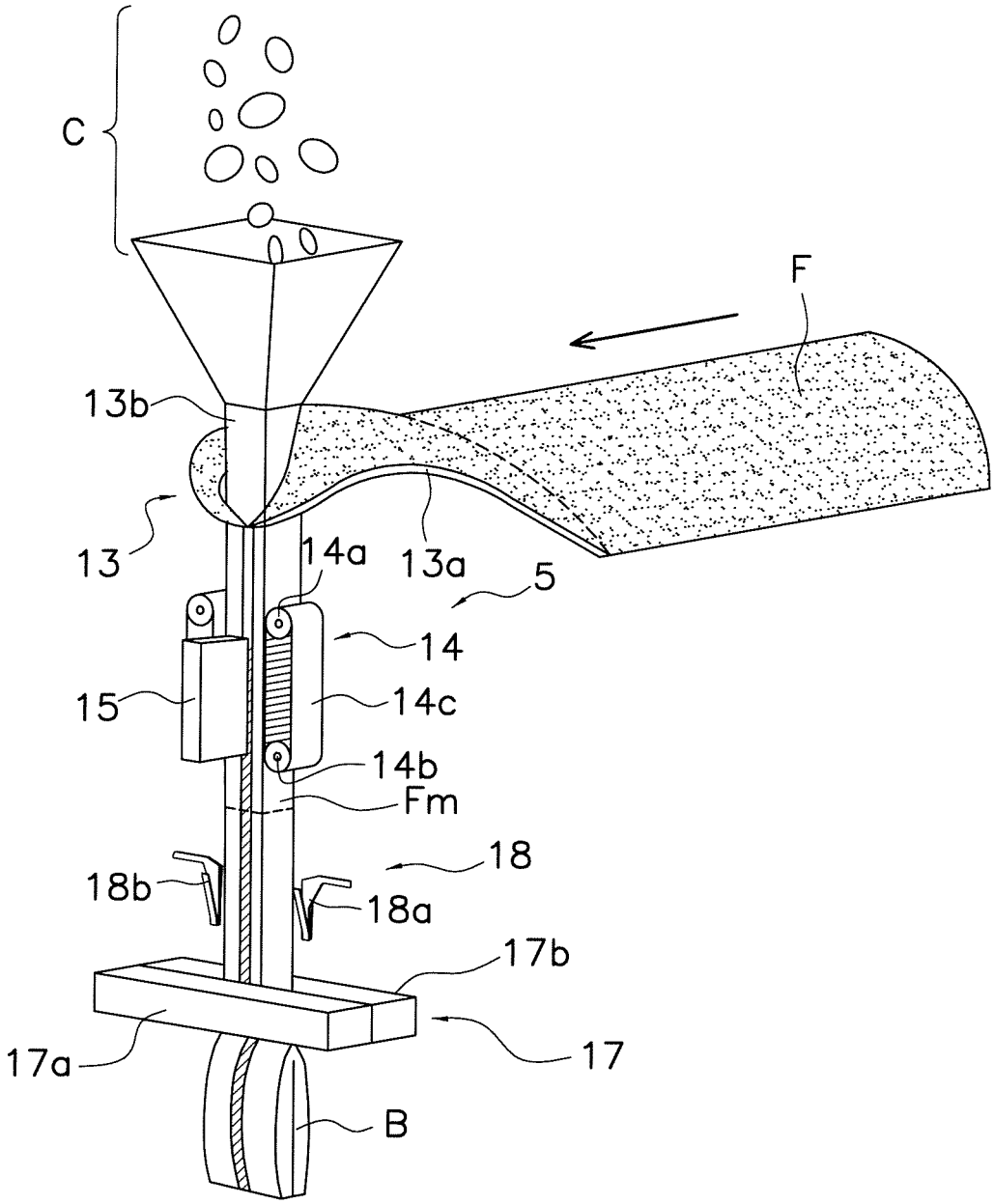
FIG. 2 is a schematic perspective view of the form-fill-seal machine.
Figure 3:
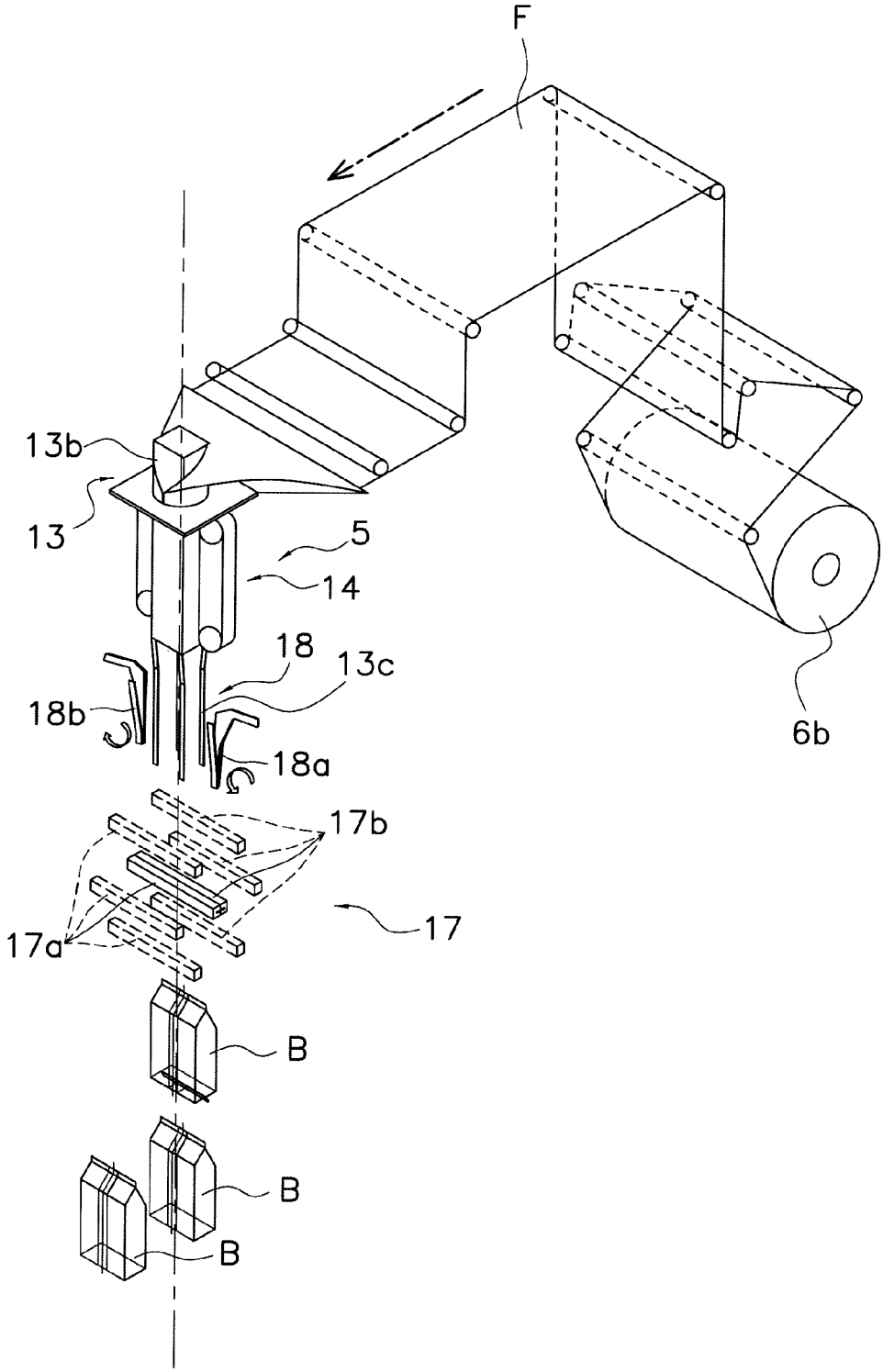
FIG. 3 is a schematic exploded perspective view of the form-fill-seal machine.

FIG. 2 is a schematic perspective view of the form-fill-seal machine, and FIG. 3 is a schematic exploded perspective view of the form-fill-seal machine. In FIGS. 1 through 3, the bag manufacturing and packaging unit 5 comprises the forming mechanism 13, a pull down belt mechanism 14, a vertical seal mechanism 15, a lateral seal mechanism 17, a gusset-forming mechanism 18, and a control part 40 (see FIG. 1).

Forming Mechanism 13

The forming mechanism 13 has a tube 13*b* and a former 13*a*. The tube 13*b* is a rectangular cylindrical member, and opens at each of upper and lower ends. The shape of the tube 13*b* is not limited to a rectangular cylinder, and may be a circular cylinder or an elliptical cylinder.

The commercial product C is introduced from the combination measuring machine 2 into the opening part at the upper end of the tube 13*b*. The former 13*a* is disposed so as to surround the tube 13*b*. The sheet of film F is formed into a rectangular cylindrical shape when caused to pass between the former 13*a* and the tube 13*b* (the film F shall be hereafter referred to as a "rectangular cylindrical film Fm"). The tube 13*b* and the former 13*a* of the forming mechanism 13 can be exchanged in accordance with the size of a bag to be manufactured.

As shown in FIG. 3, four splitters 13*c* extend downwards from each of four corners at the lower end of the tube 13*b*. The splitters 13*c* are thin plate members, and are disposed further inward than each of the four corners at the lower end of the tube 13*b* at a height at which inward-folding members 18*a*, 18*b* press against the rectangular cylindrical film Fm. Also, the splitter 13*c* provides support so that each of four corner portions of both side parts of the rectangular cylindrical film Fm are not moved further inward than necessary during gusset-forming operation by the inward-folding members 18*a*, 18*b*.

Pull Down Belt Mechanism 14

As shown in FIG. 2, the pull down belt mechanism 14 has a belt 14*c* provided to each of left and right sides on either side of the tube 13*b*, in order to grip the rectangular cylindrical film Fm wrapped around the tube 13*b* and convey it continuously downward. The pull down belt mechanism 14 uses a drive roller 14*a* and a driven roller 14*b* to circulate the belt 14*c* having a gripping function and moves the rectangular cylindrical film Fm downwards.

Vertical Seal Mechanism 15

The vertical seal mechanism 15 applies heat to, and vertically seals, an overlapping portion of the rectangular cylindrical film Fm wrapped around the tube 13*b* while pressing against the tube 13*b* at a constant pressure. The vertical seal mechanism 15 is located at a front side of the tube 13*b*, and is provided with a heater and a heater belt in contact with the overlapping portion of the rectangular cylindrical film Fm.

Lateral Seal Mechanism 17

The lateral seal mechanism 17 is disposed downward of the forming mechanism 13, the pull down belt mechanism 14, and the vertical seal mechanism 15. The lateral seal mechanism 17 sandwiches the rectangular cylindrical film Fm with a pair of seal jaws 17*a*, 17*b* while causing the two seal jaws 17*a*, 17*b* to rotate in a shape of a letter D, and forms a lateral seal portion.

Gusset-Forming Mechanism 18

Figure 4:
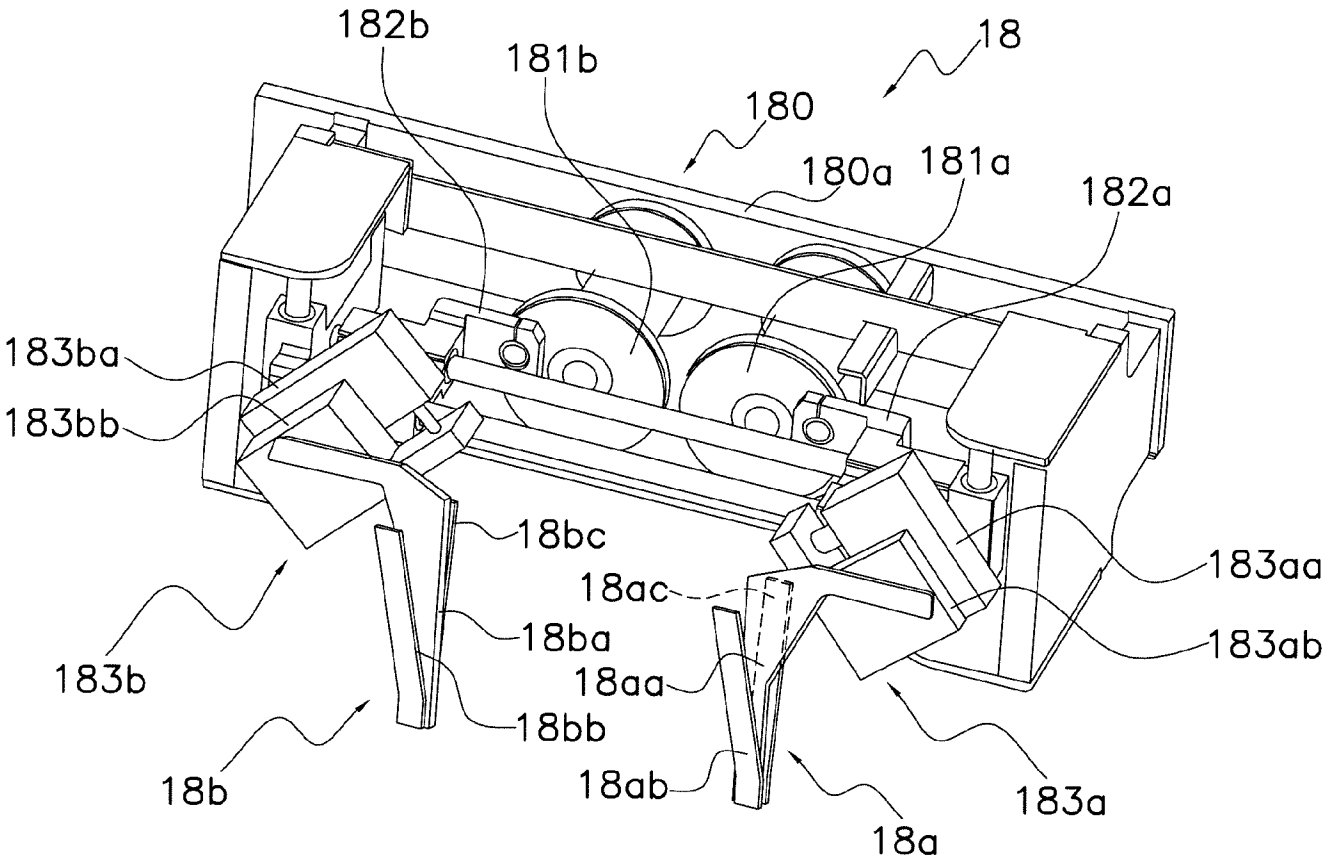
FIG. 4 is a perspective view of a gusset-forming mechanism.

FIG. 4 is a perspective view of the gusset-forming mechanism. In FIGS. 3 and 4, the gusset-forming mechanism 18 is disposed between the pull down belt mechanism 14 and the lateral seal mechanism 17, and has the pair of inward-folding members 18*a*, 18*b* and a drive device 180. The inward-folding member 18*a* and the inward-folding member 18*b* are disposed so as to be symmetrical with each other across a perpendicular line along a center of the rectangular cylindrical film Fm, and have an identical configuration; therefore, corresponding components in the inward-folding member 18*a* and the inward-folding member 18*b* are affixed with the same labels, and a description for the inward-folding member 18*b* will be addressed by a description for the inward-folding member 18*a*.

In FIG. 4, the inward-folding member 18*a* has a center plate 18*aa*, a first inclined plate 18*ab*, and a second inclined plate 18*ac*. The first inclined plate 18*ab* extends diagonally upwards from a lower end of the center plate 18*aa*. The second inclined plate 18*ac* is located on an opposite side to the first inclined plate 18*ab* across the center plate 18*aa*, and extends diagonally upwards from the lower end of the center plate 18*aa*. In other words, the first inclined plate 18*ab* and the second inclined plate 18*ac* form a V-shape. As a result, respective end surfaces of the center plate 18*aa*, the first inclined plate 18*ab*, and the second inclined plate 18*ac* form three linear contacting surfaces, and the three linear contacting surfaces form a virtual three-dimensional contacting surface. In other words, respective end surfaces of the center plate 18*aa*, the first inclined plate 18*ab*, and the second inclined plate 18*ac* form contacting portions that are three-dimensionally arranged to generally correspond to a shape of the gusset G (gusset section). Similarly, in the inward-folding member 18*b*, respective end surfaces of a center plate 18*ba*, a first inclined plate 18*bb*, and a second inclined plate 18*bc* form three linear contacting surfaces, and the three linear contacting surfaces form a virtual three-dimensional contacting surface.

The first inclined plate 18*ab* and the second inclined plate 18*ac* have spring characteristics. When an external force acts so as to move the first inclined plate 18*ab* and the second inclined plate 18*ac* closer to each other, a gap between respective distal ends of the first inclined plate 18*ab* and the second inclined plate 18*ac* becomes narrower in response to the size of the external force. Similarly, the gap between the respective distal ends of the first inclined plate 18*bb* and the second inclined plate 18*bc* of the inward folding member 18*b* also becomes narrower in response to the size of the external force.

Compared to the first inclined plate 18*ab* and the second inclined plate 18*ac*, the center plate 18*aa* projects further towards the rectangular cylindrical film Fm. When the inward-folding member 18*a* presses against the rectangular cylindrical film Fm, the center plate 18*aa* comes into contact with the rectangular cylindrical film Fm before the first inclined plate 18*ab* and the second inclined plate 18*ac*. Similarly, the center plate 18*ba* of the inward-folding member 18*b* comes into contact with the rectangular cylindrical film Fm before the first inclined plate 18*bb* and the second inclined plate 18*bc*.

The drive device 180 has cranks 181*a*, 181*b*, connecting poles 182*a*, 182*b*, and air cylinders 183*a*, 183*b*. Each of the crank 181*a*, the connecting pole 182*a*, and the air cylinder 183*a*, and each of the crank 181*b*, the connecting pole 182*b*, and the air cylinder 183*b* are respectively disposed so as to be symmetrical across the perpendicular line along the center of the rectangular cylindrical film Fm, and have an identical configuration; therefore, a description for each of the crank 181*b*, the connecting pole 182*b*, and the air cylinder 183*b* will be respectively addressed by a description for each of the crank 181*a*, the connecting pole 182*a*, and the air cylinder 183*a*.

The crank 181*a* is rotatably attached to a frame 180*a*, and is caused to rotate by a servo motor (not shown). The connecting pole 182*a* is connected at one end part to the crank 181*a*, and performs a rotating motion so as to follow the rotation of the crank 181*a*. The crank 181*b* rotates in synchronization with the crank 181*a*, and the connecting pole 182*b* performs a rotating motion so as to follow the rotation of the crank 181*b*.

The air cylinder 183*a* is fixed to another end part of the connecting pole 182*a*, and performs a rotating motion so as to follow the rotation of the connecting pole 182*a*. The air cylinder 183*a* includes a cylinder part 183*aa* and a piston part 183*ab*. When air is fed into the cylinder part 183*aa*, the piston part 183*ab* projects out. The air cylinder 183*a* is obliquely attached in advance so that the piston part 183*ab* projects diagonally downwards. Similarly, the air cylinder 183*b* also includes a cylinder part 183*ba* and a piston part 183*bb*, is obliquely attached in advance so that the piston part 183*bb* projects diagonally downwards, and performs a rotating motion so as to follow the rotation of the connecting pole 182*b*.

The inward-folding member 18*a* is attached to the piston part 183*ab* of the air cylinder 183*a*, and therefore operates so as to follow the operation of the piston part 183*ab*. Similarly, the inward-folding member 18*b* is attached to the piston part 183*bb* of the air cylinder 183*b*, and therefore operates so as to follow the operation of the piston part 183*bb*.

Operation of Gusset-Forming Mechanism 18

Figures 5A, 5B, 5C, 5D:
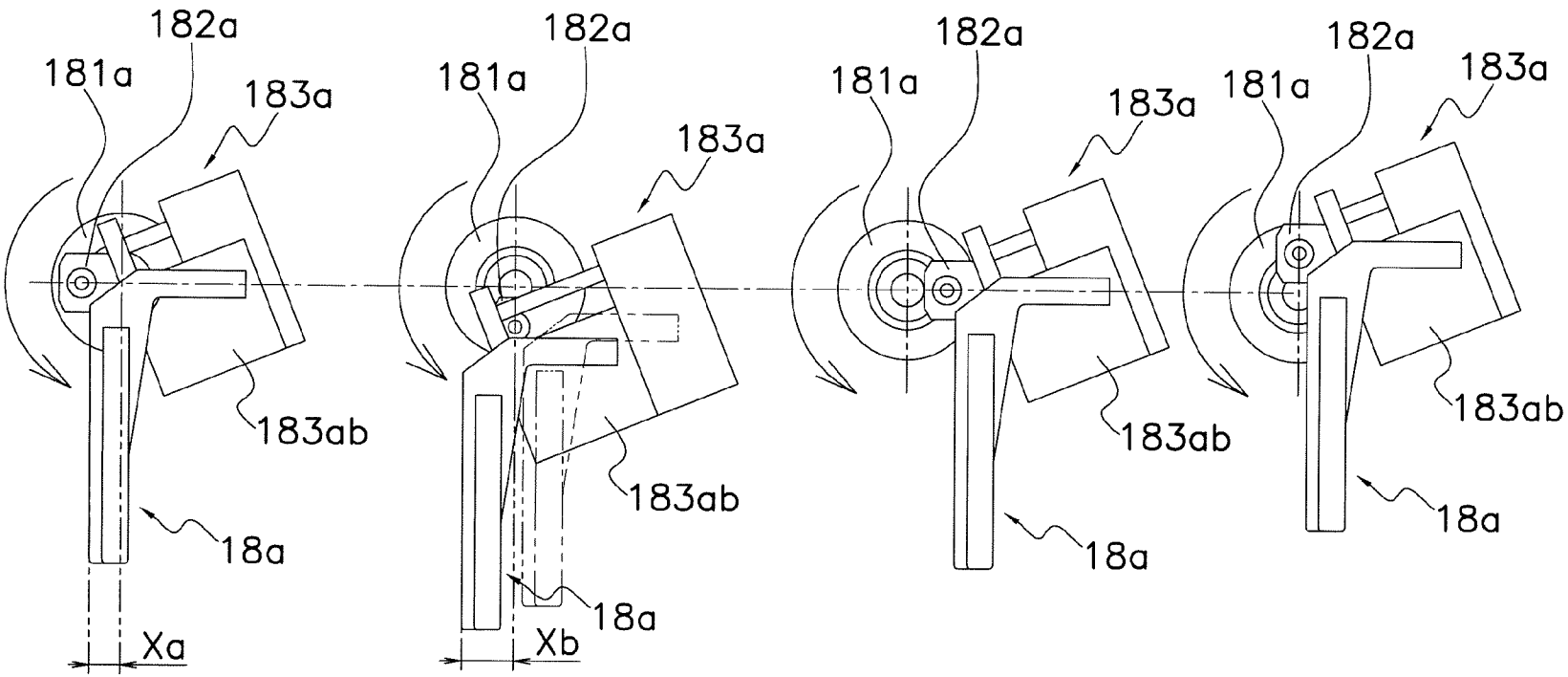
FIG. 5A is a side view of an inward-folding member that has reached a first position.
FIG. 5B is a side view of the inward-folding member that has reached a second position.
FIG. 5C is a side view of the inward-folding member that has reached a third position.
FIG. 5D is a side view of the inward-folding member that has reached a fourth position.

Each of FIGS. 5A through D is a side view of the inward-folding member, shown for each operation position of the inward-folding member. FIG. 5A is a side view of an inward-folding member that has reached a first position, FIG. 5B is a side view of an inward-folding member that has reached a second position, FIG. 5C is a side view of an inward-folding member that has reached a third position, and FIG. 5D is a side view of an inward-folding member that has reached a fourth position.

In FIG. 5A, the inward-folding member 18*a* has reached the first position, at which the rectangular cylindrical film Fm can be pressed solely by the rotation of the crank 181*a*. At the first position, an end surface of the inward-folding member 18*a* projects horizontally from a perpendicular line through a center of the crank 181*a* towards the rectangular cylindrical film Fm by a distance Xa, and an inwardly folded portion (i.e., a portion reserved for formation of a gusset G) is formed on a part of the rectangular cylindrical film Fm.

Figure 6:
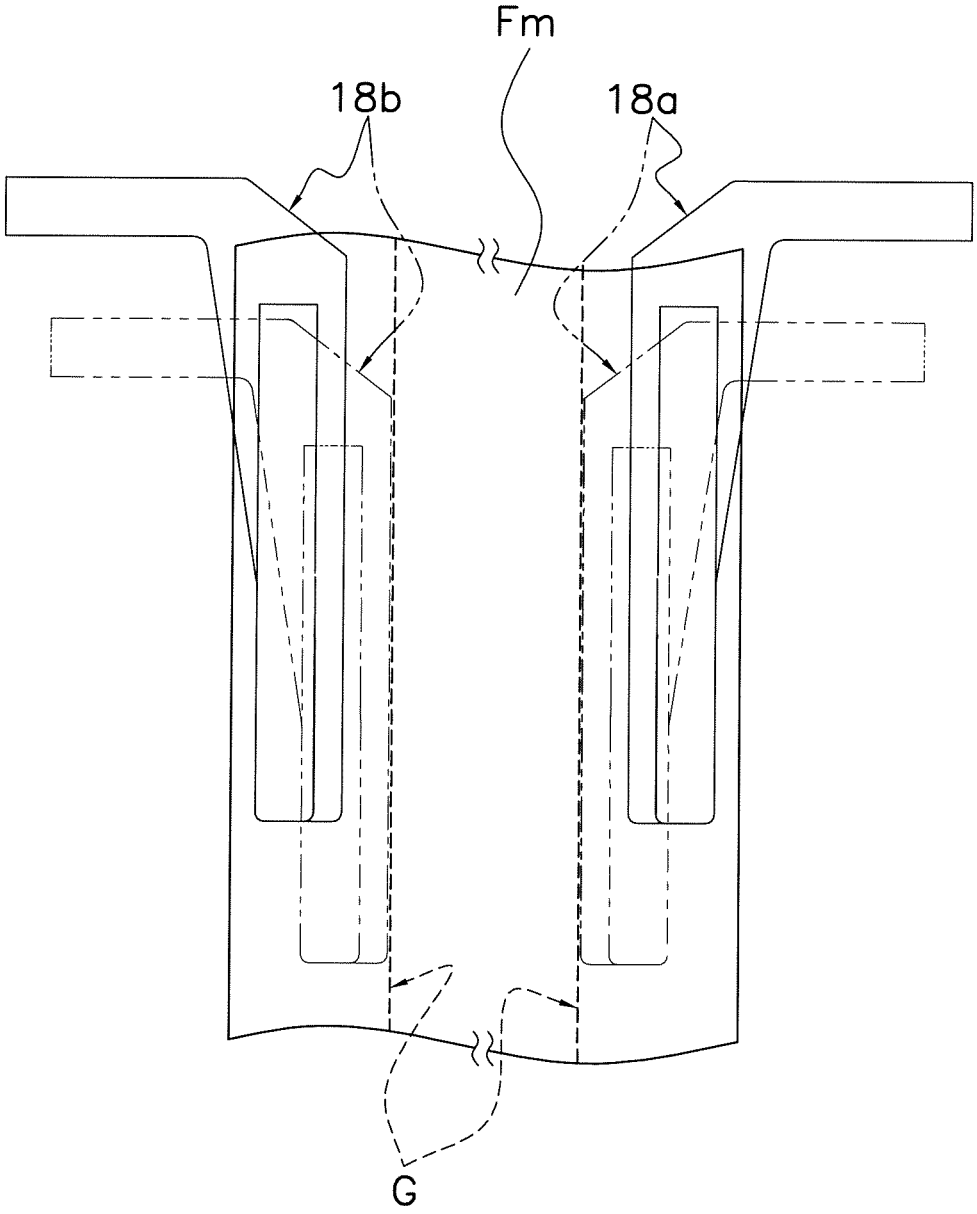
FIG. 6 is a front view of a rectangular cylindrical film in a state of being pressed by the inward-folding member.

FIG. 6 is a front view of the rectangular cylindrical film in a state of being pressed by an inward-folding member. In FIG. 6, the inward-folding member 18*a* shown by solid lines corresponds to the inward-folding member 18*a* at the position shown in FIG. 5A, whose fold-in depth is yet to reach a necessary depth (shown by dotted lines in FIG. 6). Therefore, the portion reserved for formation of the gusset G is in a state in which slackness is liable to occur.

Figure 7A:
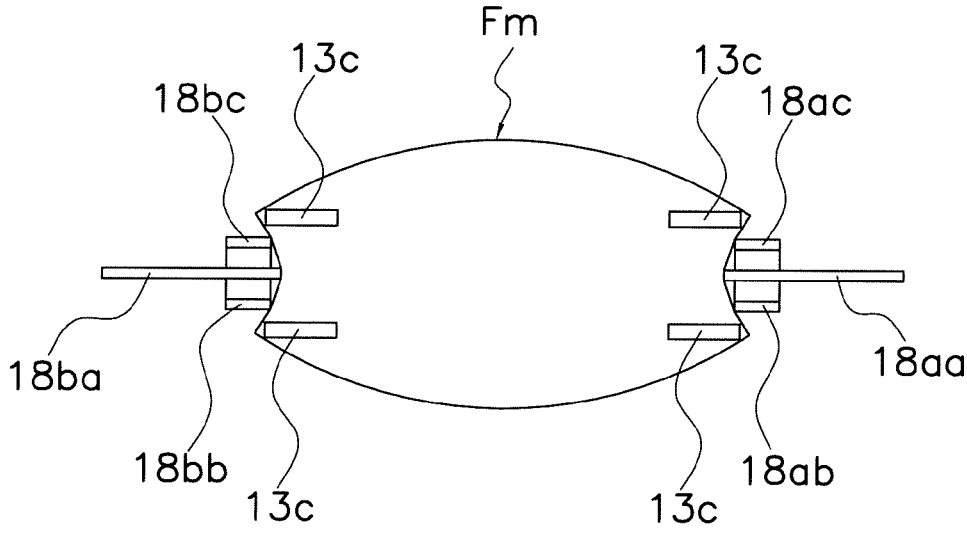
FIG. 7A is a top view of the rectangular cylindrical film when the inward-folding member has reached the position shown in FIG. 5A.

However, the inward-folding member 18*a* according to the present embodiment is configured so as to reduce the likelihood of slackness occurring in the portion reserved for formation of the gusset G. FIG. 7A is a top view of the rectangular cylindrical film when the inward-folding member has reached the position shown in FIG. 5A. In FIG. 7A, the portion of the rectangular cylindrical film Fm reserved for formation of the gusset G is pressed by respective end surfaces of the center plate 18*aa*, the first inclined plate 18*ab*, and the second inclined plate 18*ac*. For example, in an instance in which only the center plate 18*aa* is pressing against the portion reserved for formation of the gusset G, since there is a large gap between the center plate 18*aa* and each of the splitters 13*c*, no tension is generated while the fold-in depth is still small.

However, in the inward-folding member 18*a*, each area between the center plate 18*aa* and each of the splitters 13*c* is respectively pressed by the first inclined plate 18*ab* and the second inclined plate 18*bc*; therefore, tension acts between the center plate 18*aa* and each of the splitters 13*c*, and slackness is eliminated.

Next, in FIG. 5B, the inward-folding member 18*a* has reached the second position, at which the rectangular cylindrical film Fm can be pressed by an operation of the piston part 183*ab*. At the second position, the crank 181*a* has rotated by a certain amount in a direction whereby the inward-folding member 18*a* separates from the rectangular cylindrical film Fm. Although the inward-folding member 18*a* would therefore have retreated to a position shown by the long-dashed double-short-dashed line, since the piston part 183*ab* projects diagonally downwards, the end surface of the inward-folding member 18*a* projects horizontally from the perpendicular line through the center of the crank 181*a* towards the rectangular cylindrical film Fm by a distance Xb, and the depth to which the end surface of the inward-folding member 18*a* presses the rectangular cylindrical film Fm is larger in the second position than the first position by a distance Xb−Xa. In FIG. 6, the inward-folding member 18*a* shown by long-dashed double-short-dashed lines corresponds to the inward-folding member 18*a* at a position shown in FIG. 5B, whose fold-in depth has reached the necessary depth (shown by dotted lines in FIG. 6).

Figure 7B:
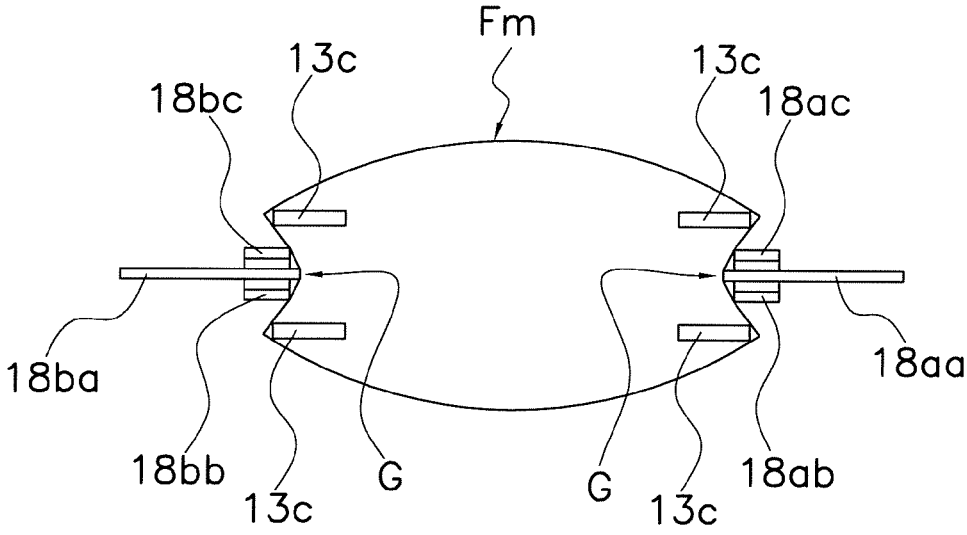
FIG. 7B is a top view of the rectangular cylindrical film when the inward-folding member has reached the position shown in FIG. 5B.

FIG. 7B is a top view of the rectangular cylindrical film when the inward-folding member has reached the position shown in FIG. 5B. In FIG. 7B, the portion of the rectangular cylindrical film Fm reserved for formation of the gusset G is pressed by the respective end surfaces of the center plate 18*aa*, the first inclined plate 18*ab*, and the second inclined plate 18*ac*. However, in correspondence with an increase in the fold-in depth, the width of the portion reserved for formation of the gusset G is reduced and the first inclined plate 18*ab* and the second inclined plate 18*bc* are pressed towards each other by the portion reserved for formation of the gusset G. Therefore, the first inclined plate 18*ab* and the second inclined plate 18*bc* move towards the center plate 18*aa*. In other words, respective upper ends of the first inclined plate 18*ab* and the second inclined plate 18*bc* approach each other in accordance with the fold-in depth. Therefore, the gusset formation area is not subjected to tension in excess of what is necessary, and conveyance of the rectangular cylindrical film Fm is not hindered.

The point in time at which the piston part 183*ab* causes the inward-folding member 18*a* to project diagonally downwards is when the crank 181*a* has rotated by a certain amount in the direction whereby the inward-folding member 18*a* separates from the rectangular cylindrical film Fm, because in an instance in which the piston part 183*ab* causes the inward-folding member 18*a* in the first position to project diagonally downwards, the fold-in depth will be excessive, and the conveyance of the rectangular cylindrical film Fm will be hindered. Accordingly, there is set a point in time at which the conveyance of the rectangular cylindrical film Fm is not hindered even when the piston part 183*ab* causes the inward-folding member 18*a* to project diagonally downwards, while the depth to which the rectangular cylindrical film Fm is pressed is larger than that in the first position.

Also, since the piston part 183*ab* causes the inward-folding member 18*a* to project diagonally downwards, not only does the inward-folding member 18*a* not hinder the conveyance of the rectangular cylindrical film Fm, but it also has an effect of smoothing the portion reserved for formation of the gusset G along a direction of conveyance, and the portion reserved for formation of the gusset G is prevented from slackening in the direction of conveyance.

In FIG. 5C, the inward-folding member 18*a* has been taken to a third position, which is the furthest from the rectangular cylindrical film Fm, by the rotation of the crank 181*a*. At this point, the inward-folding member 18*a* has been pulled back by the piston part 183*ab*, and a complete gusset G is formed in the portion reserved for formation of the gusset G.

In FIG. 5D, the inward-folding member 18*a* is in a process of being moved, by the rotation of the crank 181*a*, towards pressing the rectangular cylindrical film Fm, and has reached the fourth position at which the inward-folding member 18*a* is at its highest in the perpendicular direction.

As described above, each of the inward-folding members 18*a*, 18*b* comes into contact with the rectangular cylindrical film Fm so as to respectively sandwich left and right side surfaces of the rectangular cylindrical film Fm (i.e., portion reserved for formation of the gusset G) while moving along a circular trajectory so as to follow the rotation of the crank 181*a*, 181*b*, and inwardly folds the portion of the rectangular cylindrical film Fm reserved for formation of the gusset G. Then, each of the inward-folding members 18*a*, 18*b* temporarily moves in a direction away from the rectangular cylindrical film Fm, and again inwardly folds the portion of the rectangular cylindrical film Fm reserved for formation of the gusset G. As a result, a gusset G having no slackness is formed.

Control Part 40

The control part 40 is used for controlling the combination measuring machine 2 and the form-fill-seal machine 3; and comprises a CPU, a ROM, a RAM, and similar components. The control part 40 controls a film feed motor (not shown) for causing a film roller 6*b* in the film feed unit 6 to rotate and causing the film F to be deployed, and drive components of various mechanisms in the bag manufacturing and packaging unit 5, in accordance with an operation and settings entered from operation switches 7 and a touch panel display 8 shown in FIG. 1. Also, the control part 40 loads required information from various sensors installed on the combination measuring machine 2 and the form-fill-seal machine 3, and uses the information for various controls.

Operation of Form-Fill-Seal Machine 3

The sheet of film F is sent from the film feed unit 6 to the forming mechanism 13, wrapped from the former 13*a* onto the tube 13*b*, formed into a rectangular cylindrical shape, and then conveyed downwards by the pull down belt mechanism 14. When the film F is wrapped onto the tube 13*b*, both end parts of the film F are overlapped on a peripheral surface, and the overlapped portion is vertically sealed by the vertical seal mechanism 15.

The vertically sealed rectangular cylindrical film Fm moves off the tube 13*b* and down to the lateral seal mechanism 17. Also, at this time, an aggregation of the commercial product C falls through the tube 13*b* from the combination measuring machine 2. A gusset is formed in the rectangular cylindrical film Fm in the gusset-forming mechanism 18, and with the commercial product C contained therein, the rectangular cylindrical film Fm is then thermally sealed in a lateral direction at each of a portion that corresponds to a top end of a bag B and a portion that corresponds to a bottom end of a bag above the bag B, in the lateral seal mechanism 17, by the pair of seal jaws 17*a*, 17*b* rotating so as to follow an annular trajectory.

(1) In the form-fill-seal machine 3, the respective pressing part of the inward-folding members 18*a*, 18*b* is formed by the respective end surfaces of the center plate 18*aa*, 18*ba*, the first inclined plate 18*ab*, 18*bb*, and the second inclined plate 18*ac*, 18*bc* so as to produce three linear contacting surfaces that define contacting portions that are three-dimensionally arranged to generally correspond to a shape of the gusset G. The pressing part presses from an outside of the rectangular cylindrical film Fm against the portion reserved for formation of the gusset G between the splitters 13*c*. Here, the portion reserved for formation of the gusset G clings to the respective end surfaces of the center plate 18*aa*, 18*ba*, the first inclined plate 18*ab*, 18*bb*, and the second inclined plate 18*ac*, 18*bc*, and the portion reserved for formation of the gusset G is pressed three-dimensionally. As a result, the slackness in the portion reserved for formation of the gusset G is substantially eliminated, and a gusset having an appealing appearance is formed.

(2) In the form-fill-seal machine 3, the four splitters 13*c* form four corners of the tubular packaging material, and minimize shape distortion of the four corners.

(3) In the form-fill-seal machine 3, the crank 181*a*, 181*b* causes the inward-folding member 18*a*, 18*b* to perform a rotating motion for causing the pressing part to press against, and separate from, the portion reserved for formation of the gusset G. The air cylinder 183*a*, 183*b*causes the inward-folding member 18*a*, 18*b* performing the rotating motion to perform a reciprocating motion for causing the pressing part to project diagonally downwards and press against, and separate from, the portion reserved for formation of the gusset G. Even in an instance in which the gusset formation area becomes slack after the inward-folding member 18*a*, 18*b* performing a rotating motion separates from the portion reserved for formation of the gusset G, the reciprocating motion of the inward-folding member 18*a*, 18*b* causes the inward-folding member 18*a*, 18*b* to again inwardly fold the portion reserved for formation of the gusset G. Therefore, the fold-in depth increases, the fold-in amount along the direction of conveyance of the tubular packaging material increases, slackness is substantially eliminated, and a gusset G having an appealing appearance is formed.

Other Embodiments

A description was given above for the form-fill-seal machine 3 according to one embodiment of the present invention. However, the present invention is not limited in scope to the above embodiment; it may be modified provided that no departure is made from the scope of the invention.

In the above embodiment, the respective pressing part of the inward-folding members 18*a*, 18*b* is formed by the respective end surfaces of the center plate 18*aa*, 18*ba*, the first inclined plate 18*ab*, 18*bb*, and the second inclined plate 18*ac*, 18*bc* so as to have three linear contacting surfaces. However, each of the pressing part of the 18*a*, 18*b* may form a continuous three-dimensional contacting surface that includes a plurality of contacting portions that are three-dimensionally arranged to generally correspond to a shape of the gusset G.

The cross-sectional profile of the portion reserved for formation of the gusset G when cut along a plane perpendicular to the direction of conveyance of the rectangular cylindrical film Fm turns into an isosceles triangle whose vertex angle becomes smaller towards the seal jaw 17*a*, 17*b* from nearer the lower end of the tube 13*b*. Therefore, when, for example, the pressing part of the inward-folding member 18*a*, 18*b* forms a three-dimensional contacting surface so that the cross-sectional profile of the pressing part of the inward-folding member 18*a*, 18*b* is an equilateral triangle or an isosceles triangle whose vertex angle becomes smaller towards the seal jaw 17*a*, 17*b* from nearer the lower end of the tube 13*b*, the gusset G can be more accurately and readily formed.

As described above, the illustrated embodiments are useful for a form-fill-seal machine for forming a gusset while continuously conveying a packaging material.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A form-fill-seal machine adapted to manufacture a bag having a gusset section, the form-fill-seal machine comprising:

a conveying part configured and arranged to convey a tubular packaging material;

a plurality of splitters extending along a conveyance direction of the tubular packaging material to contact with the tubular packaging material from an interior side, the splitters being non-movably fixed in position relative to the conveying part;

a lateral seal mechanism having a pair of seal jaws that rotate following an annular trajectory, the pair of seal jaws of the lateral seal mechanism being configured to seal the tubular packaging material in a lateral direction;

an inward-folding member having a pressing part including a plurality of contacting portions that are three-dimensionally arranged to generally correspond to a shape of the gusset section, the inward-folding member being configured and arranged to move for each bag produced from a first position spaced apart from an external side of the tubular packaging material to a second position in which the inward-folding member presses the contacting portions of the pressing part against the external side of the tubular packaging material against an outer surface of a gusset formation area of the tubular packaging material located between the splitters to form the gusset section before the lateral seal mechanism seals the tubular packaging material in the lateral direction;

a first actuator configured and arranged to move the inward-folding member in a first motion in which the pressing part presses against and separates from the gusset formation area of the tubular packaging material while the inward-folding member performs a rotating motion; and a second actuator configured and arranged to move the inward-folding member in a second motion, in which the pressing part presses against and separates from the gusset formation area diagonally downwards relative to a horizontal direction, independently of the first motion while the first actuator moves the inward-folding member in the first motion.

2. The form-fill-seal machine according to claim 1, wherein the splitters are arranged with respect to the conveying part to form four corners of the tubular packaging material.

3. The form-fill-seal machine according to claim 1, wherein the pressing part forms three linear contacting surfaces defining the contacting portions.

4. The form-fill-seal machine according to claim 1, wherein the second actuator is configured and arranged to move the inward-folding member in the second motion after the pressing part of the inward-folding member moving in the first motion separates from the gusset formation area of the tubular packaging material.

5. The form-fill-seal machine according to claim 1, wherein the pressing part includes a first plate and a second plate that face each other, the first plate and the second plate being arranged such that, when an external force acts so as to move the first plate and the second plate closer to each other, a gap between the first plate and the second plate becomes narrower in response to the external force.

6. The form-fill-seal machine according to claim 5, wherein the first plate and the second plate are configured and arranged to press against the gusset formation area of the tubular packaging material to inwardly fold the tubular packaging material while a width of the gusset formation area becomes narrower as the first plate and the second plate move closer to each other according to a fold-in depth.

7. The form-fill-seal machine according to claim 6, wherein a gap between upper ends of the first plate and the second plate is larger than a gap between lower ends of the first plate and the second plate so that the first and second plates form a V-shape, and the first plate and the second plate are configured and arranged to press against the gusset formation area of the tubular packaging material to inwardly fold the tubular packaging material as the gap between the upper ends of the first plate and the second plate becomes narrower according to the fold-in depth.

8. The form-fill-seal machine according to claim 5, wherein the first plate and the second plate are resilient plate members.

9. A form-fill-seal machine adapted to manufacture a bag having a gusset section, the form-fill-seal machine comprising:

a conveying part configured and arranged to convey a tubular packaging material;

a plurality of splitters non-movably fixed to the conveying part and extending along a conveyance direction of the tubular packaging material to contact with the tubular packaging material from an interior side;

an inward-folding member having a pressing part including a plurality of contacting portions that are three-dimensionally arranged to generally correspond to a shape of the gusset section, the inward-folding member being configured and arranged to move from a first position spaced apart from an external side of the tubular packaging material to a second position in which the inward-folding member presses the contacting portions of the pressing part against the external side of the tubular packaging material against an outer surface of a gusset formation area of the tubular packaging material located between the splitters to form the gusset section;

a first actuator configured and arranged to move the inward-folding member in a first motion, in which the pressing part presses against and separates from the gusset formation area of the tubular packaging material while the inward-folding member performs a rotating motion; and a second actuator configured and arranged to move the inward-folding member in a second motion, in which the pressing part presses against and separates from the gusset formation area diagonally downwards relative to a horizontal direction, independently of the first motion while the first actuator moves the inward-folding member in the first motion, wherein the splitters are further configured to support each of four corner portions of both side parts of the tubular packaging material at a height at which the inward-folding members press against the tubular packaging material.

10. The form-fill-seal machine according to claim 9, wherein the splitters are arranged with respect to the conveying part to form four corners of the tubular packaging material.

11. The form-fill-seal machine according to claim 9, wherein the pressing part forms three linear contacting surfaces defining the contacting portions.

12. The form-fill-seal machine according to Claim 7, wherein the second actuator is configured and arranged to move the inward-folding member in the second motion after the pressing part of the inward-folding member moving in the first motion separates from the gusset formation area of the tubular packaging material.

13. The form-fill-seal machine according to claim 9, wherein the pressing part includes a first plate and a second plate that face each other, the first plate and the second plate being arranged such that, when an external force acts so as to move the first plate and the second plate closer to each other, a gap between the first plate and the second plate becomes narrower in response to the external force.

14. The form-fill-seal machine according to claim 13, wherein the first plate and the second plate are configured and arranged to press against the gusset formation area of the tubular packaging material to inwardly fold the tubular packaging material while a width of the gusset formation area becomes narrower as the first plate and the second plate move closer to each other according to a fold-in depth.

15. The form-fill-seal machine according to claim 14, wherein a gap between upper ends of the first plate and the second plate is larger than a gap between lower ends of the first plate and the second plate so that the first and second plates form a V-shape, and the first plate and the second plate are configured and arranged to press against the gusset formation area of the tubular packaging material to inwardly fold the tubular packaging material as the gap between the upper ends of the first plate and the second plate becomes narrower according to the fold-in depth.

16. The form-fill-seal machine according to claim 13, wherein the first plate and the second plate are resilient plate members.

* * * * *